US005641018A

United States Patent [19]

King

[11] Patent Number: 5,641,018

[45] Date of Patent: Jun. 24, 1997

[54] APPARATUS AND METHOD FOR CEMENTING WELLS

[76] Inventor: Harlan R. King, Rte. 1, Box 329, Stringer, Miss. 39481

[21] Appl. No.: 372,044

[22] Filed: Jan. 12, 1995

[51] Int. Cl.[6] ..... E21B 33/08

[52] U.S. Cl. ..... 166/172; 166/173; 166/175; 166/177.3

[58] Field of Search ..... 166/311, 170, 166/172, 175, 177.3, 202, 332, 241.4, 241.6; 15/220.4

[56] References Cited

U.S. PATENT DOCUMENTS

| | | | |
|---|---|---|---|
| 2,611,146 | 9/1952 | Buckley | 15/220.4 |
| 2,655,679 | 10/1953 | Grant | 15/220.4 |
| 2,809,012 | 10/1957 | Stevens | 15/220.4 |
| 2,966,690 | 1/1961 | Taylor, Jr. | 15/220.4 |
| 3,124,196 | 3/1964 | Solum | 166/241.6 |
| 3,200,884 | 8/1965 | Solum et al. | 166/241.6 |
| 3,822,753 | 7/1974 | Tate | 175/84 |
| 4,531,582 | 7/1985 | Muse et al. | 166/172 X |

*Primary Examiner*—Frank Tsay

[57] ABSTRACT

An apparatus and method for cementing a pipe in a well. A wiper is engaged with a pipe section as the pipe section is lowered into the wellbore. The wiper contacts the wellbore as the pipe section is reciprocated or rotated within the wiper. The wiper contacts and cleans the exterior surface of the pipe section as the pipe section is moved relative to the wiper. By cleaning the exterior of the pipe section before cement is placed between the pipe section and the wellbore, the potential for channeling in the microannulus between the pipe section exterior and the cement is substantially reduced.

13 Claims, 1 Drawing Sheet

APPARATUS AND METHOD FOR CEMENTING WELLS

BACKGROUND OF THE INVENTION

The present invention relates to the field of cementing pipe in wellbores. More particularly, the present invention relates to an improved apparatus and method for improving the bond between the downhole pipe and cement place in the wellbore.

The production of oil and gas requires production casing to be set in the wellbore. The production casing provides a conduit for transporting the hydrocarbon fluids from the subsurface formation to the well surface. To prevent the migration of the hydrocarbon fluids around the exterior of the casing, and to prevent the dilution of the hydrocarbon fluids with water produced from other strata, cement is placed in the annulus between the exterior of the casing and the interior of the wellbore.

To facilitate the formation of a strong cement bond around the casing, pipe centralizers typically are installed on casing sections to center the casing in the wellbore so that an even thickness of cement is located on all sides of the casing. This technique restricts channeling of the cement, and the creating of voids in the cement, caused when the casing rests against the wellbore surface.

Several factors adversely affect the cementing process. Mud cake on the wellbore surface can prevent a good bond between the cement and the wellbore. To avoid this problem, scratching tools having wires or bristles are run in the wellbore to dislodge mud cake from the wellbore. Additionally, the dehydration of the cement as the cement cures causes shrinkage of the cement, and the possibility of hairline cracks in the bond between the casing and cement. This differential contraction is heightened by temperature variations in the wellbore, casing, and cement. While wellbore temperatures may exceed 350 degrees F, the initial temperature of the casing may be below freezing in winter operations. Similarly, the temperature of the cement is typically different than the wellbore and casing temperatures. All of these potential variations in temperature can adversely affect the ability of the cement to form a solid seal between the casing and the wellbore.

The bond between the casing and the cement is also restricted by the formation of mud cake on the exterior surface of the casing. When the casing is run into the wellbore, the casing contacts drilling mud and forms a hard cake or impurities on the exterior surface of the casing. This mud cake can be extremely hard when subject to elevated temperatures in the wellbore. While floats such as rubber plugs are typically run through the interior of the casing during cementing operations to swab the interior of the casing, no steps are taken to clean the outside surface of the casing before the cement is placed in the wellbore. The failure to remove the mud cake from the exterior surface of the casing can leave a microannulus leading to failure of the cement seal.

In deep wells, the bottom hole pressure can exceed 18,000 psi. If a hairline fracture or microannulus permits the migration of fluids from a water zone to a hydrocarbon producing zone, the water will be forced through such fracture at high pressures. This migration will cause erosion of the cement or softer mud cake, and can eventually open a large channel between the water and hydrocarbon producing zones. If enough water dilutes the hydrocarbon producing zone, additional expense is incurred to produce the hydrocarbon fluids, and total hydrocarbon production from the zone can be lost.

The migration of gas through the microannulus around the outside of the casing also increases the risk of well blowout. If the gas travels to a depleted zone, an underground blowout can occur. Alternatively, the newly pressurized zone can cause safety hazards for new drilling activity because the traditional warning signs of a high pressure zone, such as connection gas, background gas, temperature increases, changes in shale density, and penetration rate increases, may not be present in the artifically created pressure zone. If enough gas migrates through the microannulus to the well surface, the gas can escape in an uncontrolled fashion and cause a disastrous surface blowout.

Accordingly, a need exists for an improved apparatus and method for cementing wells that improves the bond between the cement and the exterior surface of the casing.

SUMMARY OF THE INVENTION

The present invention provides and improved apparatus and method for cementing pipe in a wellbore. The apparatus cleans the exterior surface of the pipe and comprises a body and a wiper engaged with the body for contacting the exterior surface of the pipe. In different embodiments of the invention, the wiper can be integrally formed with the body, and can permit the reciprocation or rotation of the pipe within the wiper. In other embodiments of the apparatus, the body can comprise a centralizer, or can be engaged with a centralizer, for centering the pipe in the wellbore.

The method of the invention is practiced by providing a wiper for contacting the exterior surface of the pipe, and by moving the pipe relative to the wiper to clean the pipe exterior surface. In other embodiments of the method, the wiper can be substantially immmobilized in the wellbore, and the pipe can be reciprocated or rotated relative to the wiper.

DESCRIPTION OF THE PREFERRED EMBODIMENTS

Figure 1:
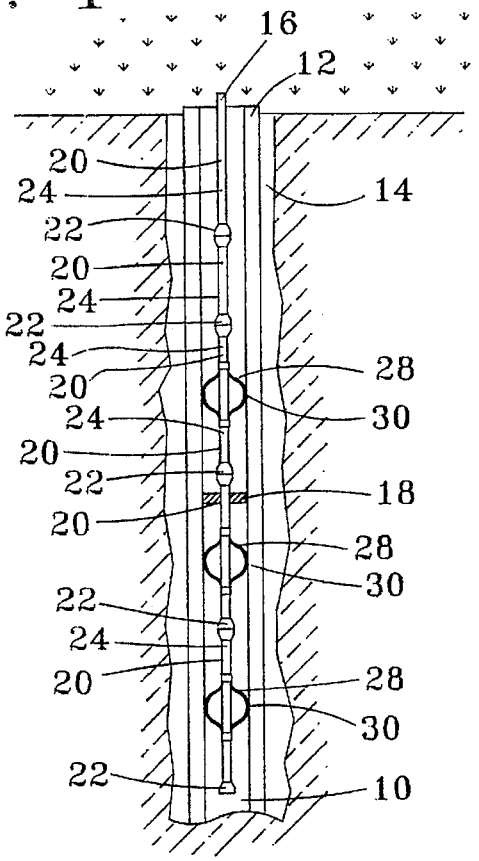
FIG. 1 illustrates an elevation view of a casing positioned in a wellbore.

The present invention describes an improved apparatus and method for cementing a pipe such as a casing in a wellbore. Referring to FIG. 1, wellbore 10 is drilled into the subsurface geologic formations, and conductor casing 12 and surface casing 14 are positioned in wellbore 10. Production casing or pipe 16 is positioned in wellbore 10 and extends from the surface to the hydrocarbon producing zone. If desired, production packer 18 can be placed in the annulus between pipe 16 and wellbore 10 to prevent the migration of fluids through such annulus.

Figure 2:
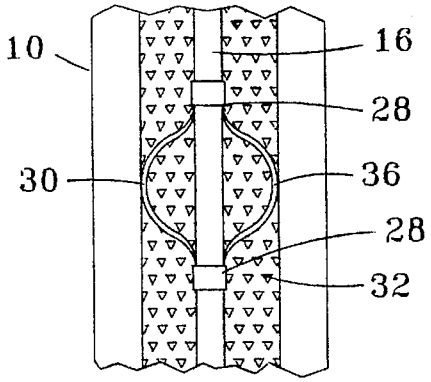
FIG. 2 illustrates a pipe section after cement has been pumped into the annulus between the pipe and wellbore.

Pipe 16 is constructed with pipe sections 20 typically having a length of forty feet. As shown in FIG. 2, adjacent pipe sections 20 are joined with a pipe joint 22 having an exterior diameter greater than the outside diameter of pipe section body 24. This larger dimension in pipe joint 22 is typically formed by the box end of pipe body 24, although uniform diameter coiled tubing (not shown) can also be used as pipe 16. Pipe shoe 26 anchors the lower end of pipe string 16 in wellbore 10.

Referring to FIG. 1, a wiper 28 is positioned adjacent each pipe section 20 between each pipe joint 22. Wipers 28 are loosely engaged with each pipe body 24 so that pipe 16 can be moved relative to wipers 28. In a preferred embodiment of the invention, each wiper 28 incorporates a centralizer 30 that centers wipers 28 within wellbore 10. Depending on the configuration of wipers 28, centralizers 30 can also serve to centralize pipe 16 in wellbore 10.

In one embodiment of the invention, wipers 28 and attached centralizers 30 are engaged with pipe string 16 and are lowered into wellbore 10. In a preferred embodiment of the invention, wipers 28 have an interior dimension greater than the outside diameter of pipe body 24 and less than the outside diameter of pipe joint 22. Consequently, each wiper 28 will float along corresponding pipe body 24 and is restrained by pipe joint 22 from further movement. If uniformed dimension pipe such as coiled tubing is used for pipe 16, then collars or similar devices (not shown) can be attached to pipe 16 to provide the function of pipe joint 22.

When pipe 16 reaches the desired position in wellbore 10, centralizers 30 grip wellbore 10 and substantially immobilize wipers 28 in a fixed position. Pipe 16 can be reciprocated and rotated to move pipe 16 relative to wipers 28, and will not dislodge wipers 28 from the fixed position relative to wellbore 10 unless pipe 16 is moved axially in wellbore 10 over a distance greater than the distance between adjacent pipe joints 22. As pipe 16 is rotated or reciprocated, cement 32 can be pumped through pipe 16 and into wellbore 10 with equipment and techniques well known in the art. When cement 32 has cured, cement 32 connects pipe 16 to wellbore 10 as shown in FIG. 2.

As previously described, cement 32 provides a seal in the annulus between pipe 16 and wellbore 10 that prevents the migration or flow of water and other fluids from one strata to another. By moving wipers 28 relative to pipe 16 before cement 32 is pumped into the annulus between pipe 16 and wellbore 10, wipers 28 clean mud cake and other impurities from the exterior surface of each pipe body 24. This cleaning process removes impurities that would otherwise dilute cement 32 or prevent cement from forming a uniform seal in the annulus. This cleaning process facilitates efficient adherence between cement 32 and pipe 16, and substantially reduces the risk of fluid channeling between cement 32 and pipe 16.

Figure 3:
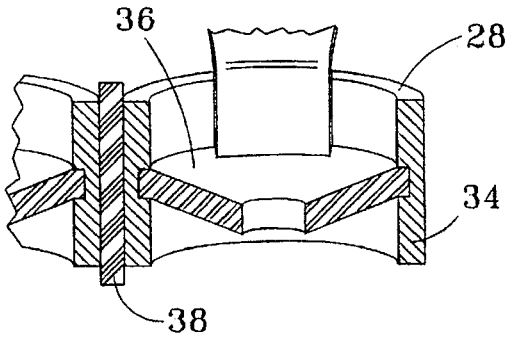
FIG. 3 illustrates a sectional view of a wiper.

Referring to FIG. 3, a sectional view of one embodiment for wiper 28 is illustrated. As shown, wiper 28 comprises ring 34 and wiper seals 36. Ring 34 is sectioned into two elements attached with hinge 38 to facilitate the installation of ring 34 about pipe body 24. Seal 36 can comprise different configurations and can be attached to ring 34 in any manner sufficient to perform the intended result. For example, seal 36 can comprise a plurality of seal elements, and can be shaped as a ring or as vertical or helical blades. Seal 36 can be constructed from a single material or from composite materials having the desired flexibility, strength, and durability, including metallic elements, elastomers, plastics or other synthetic materials.

Figure 4:
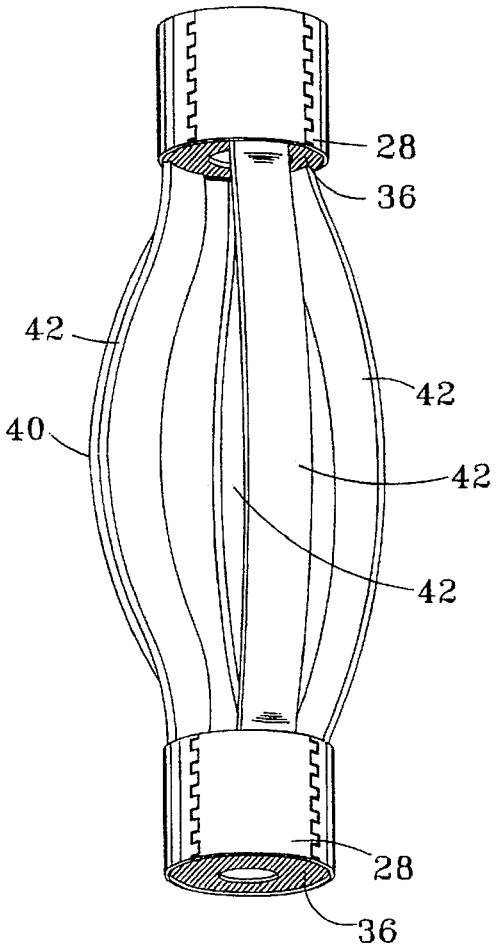
FIG. 4 illustrates an elevation view of a wiper attached to a bow-type centralizer.

As shown in FIG. 4, wiper 28 can be attached to a conventional centralizer such as bow type centralizer 40. Centralizer 40 includes flexible springs 42 that are engagable with wellbore 10 to substantially immobolize centralizer against slight movements of pipe 16, yet which permit the retrieval of pipe 16 and wipers 28 from wellbore 10 with sufficient lift force from the well surface. As shown in FIG. 4, wipers 28 can be positioned at the upper and lower ends of centralizer 40 with a weld, threaded connection, clips, or other attachment techniques known in the art.

Although the invention has been described in terms of certain preferred embodiments, it will become apparent to those of ordinary skill in the art that modifications and improvements can be made to the inventive concepts herein without departing from the scope of the invention. The embodiments described herein are merely illustrative of the inventive concepts and should not be interpreted as limiting the scope of the invention.

What is claimed is:

1. An apparatus for cleaning the exterior surface of a pipe downhole in a wellbore, comprising:

a body transportable downhole into the wellbore for selective engagement with the wellbore and for permitting relative movement between the pipe and said body when said body is engaged with the wellbore; and a wiper attached to said body for contacting the exterior surface of the pipe to clean said exterior surface as the pipe moves relative to said body when said body is engaged with the wellbore.

2. An apparatus as recited in claim 1, wherein said body comprises a substantially cylindrical ring around the pipe.

3. An apparatus as recited in claim 1, wherein said body centralizes the pipe in the wellbore.

4. An apparatus as recited in claim 1, wherein said wiper is rotatable about the exterior surface of the pipe.

5. An apparatus as recited in claim 1, further comprising a stop attached to the exterior surface of the pipe for restricting movement of the pipe relative to said body.

6. An apparatus as recited in claim 1, wherein said wiper is sufficiently flexible to maintain contact with the exterior surface of the pipe as the pipe is reciprocated relative to said wiper.

7. An apparatus for cleaning the exterior surface of a pipe section downhole in a wellbore, wherein said pipe section has a cylindrical exterior surface and a larger diameter flanged end portion, said apparatus comprising:

a body transportable downhole into the wellbore and moveable relative to the cylindrical exterior surface of the pipe section, wherein said body is configured to resist relative movement between said body and the flanged end portion of the pipe section;

a centralizer attached to said body for selective engagement with the wellbore and for permitting relative movement between the pipe section and said body when said body is engaged with the wellbore; and a wiper engaged with said body for contacting the exterior surface of the pipe section to clean said exterior surface as the pipe section moves relative to said body and attached centraliser when said centralizer is engaged with the wellbore.

8. An apparatus as recited in claim 7, wherein the pipe section further has a threaded end portion opposite the flanged end portion for engagement with the flanged end portion of an adjacent pipe section, and wherein said body has a dimension less than the outer dimension of the flanged end portions to prevent the movement of said body beyond the pipe section exterior surface.

9. A method for cleaning the exterior surface of a pipe downhole in a wellbore, comprising:

providing a body having an attached wiper for contacting the exterior surface of the pipe;

transporting said body downhole into the wellbore;

engaging said body to the wellbore; and moving the pipe relative to said wiper to clean the exterior surface of the pipe.

10. A method as recited in claim 9, further comprising the step of reciprocating the pipe relative to said wiper.

11. A method as recited in claim 9, further comprising the step of rotating the pipe relative to said wiper.

12. A method as recited in claim 9, wherein the pipe is formed by pipe sections with flanged ends having an enlarged exterior dimension, further comprising the steps of positioning said body and attached wiper in moveable engagement along the exterior surface of a selected pipe section between adjacent flanged pipe section ends, wherein said wiper has an interior dimension less than the dimension of the flanged pipe section ends, of lowering the pipe section and said wiper downhole into the wellbore until said body reaches a selected location within the wellbore, and of reciprocating the pipe relative to said wiper.

13. A method as recited in claim 9, further comprising the step of attaching a centralizer to said wiper for centralizing said wiper in the wellbore.

* * * * *